US005406313A

United States Patent [19]

Noami et al.

[11] Patent Number: 5,406,313

[45] Date of Patent: Apr. 11, 1995

[54] COLOR IMAGE FORMING APPARATUS AND METHOD

[75] Inventors: Tsuneo Noami; Kazuo Maruyama; Takeshi Sumikawa; Nobumasa Furuya, all of Kanagawa, Japan

[73] Assignee: Fuji Xerox Co., Ltd., Tokyo, Japan

[21] Appl. No.: 80,059

[22] Filed: Jun. 23, 1993

Related U.S. Application Data

[63] Continuation of Ser. No. 646,273, Jan. 28, 1991, abandoned.

[30] Foreign Application Priority Data

Jan. 29, 1990 [JP] Japan ..... 2-16174

[51] Int. Cl.[6] ..... G03G 15/01

[52] U.S. Cl. ..... 347/115; 355/327; 430/45

[58] Field of Search ..... 355/210, 268, 326 R, 355/327; 346/157, 160, 108, 76 L; 430/42, 44, 45

[56] References Cited

U.S. PATENT DOCUMENTS

| | | | |
|---|---|---|---|
| 4,803,518 | 2/1989 | Haneda et al. | 355/326 |
| 4,831,408 | 5/1989 | Yoshikawa et al. | 346/157 |
| 4,833,505 | 5/1989 | Furuya et al. | 355/326 |
| 4,937,629 | 6/1990 | Marayama et al. | 355/265 |
| 4,937,630 | 6/1990 | Yoshikawa et al. | 355/326 X |

FOREIGN PATENT DOCUMENTS

| | | |
|---|---|---|
| 58-57139 | 9/1981 | Japan . |
| 60-247650 | 5/1984 | Japan . |
| 63-142363 | 12/1986 | Japan . |
| 1-287581 | 6/1988 | Japan . |
| 2-19875 | 7/1988 | Japan . |

*Primary Examiner*—Robert B. Beatty
*Attorney, Agent, or Firm*—Finnegan, Henderson, Farabow, Garrett & Dunner

[57] ABSTRACT

A first negative or positive latent electrostatic image is formed on a latent image bearing body with a first writing device, and developed with a monochromatic toner. A second latent image of the type different than the first latent image is formed by a second writing device after setting the background voltage of the second image to have an absolute value larger than the first image, and then developed with one or two color toners selected from three color toners of respective multi-color developing units. A plurality of multi-color toner images may be formed in respective rotation cycles of the latent image bearing body. A monochromatic toner image may be formed in the same rotation cycle as one of the multi-color toner images. Finally, a plurality of toner images thus produced are transferred onto a recording sheet at once after polarities of the plurality of toner images have been arranged into the same polarity.

8 Claims, 10 Drawing Sheets

COLOR IMAGE FORMING APPARATUS AND METHOD

This application is a continuation of application Ser. No. 07/646,273, filed Jan. 28, 1991, now abandoned.

BACKGROUND OF THE INVENTION

1. Field of the Invention

The present invention relates to a color image forming apparatus and a method of using the same, and more particularly to a color image forming apparatus for forming latent images for a plurality of color images on a latent image bearing body and transferring the color images on a record sheet at a time, and a method of using such a color image forming apparatus.

2. Discussion of the Related Art

An example of printers known as color image forming apparatuses is of the so-called transfer drum type. In this type of printer, a photoreceptor drum rotating plural times is provided. Through the respective rotating cycles of the photoreceptor drum, toner images of the colors respectively corresponding to the rotating cycles are formed on the photoreceptor drum. A transfer drum is also provided, which rotates in contact with the photoreceptor drum and around which a record sheet is wound. The color toner images are transferred from the photoreceptor drum superposedly onto the record sheet, through the rotating cycles of the photoreceptor drum.

The printer of this type can form full-color images. However, even in forming images of two colors (e.g., black and red), which operation is frequently requested by users, it must rotate the photoreceptor drum plural times. Accordingly, it takes much time to form two-color images, like the case of forming full-color images.

There are proposals directed to the problem just mentioned (Japanese Patent Application Unexamined Publication Nos. Sho. 58-57139 and Sho. 60-247650). In the proposals, toner images for plural colors are formed on the photoreceptor drum, and are transferred from the photoreceptor drum onto a record sheet at once.

In the color image forming apparatuses proposed, a two- or three-color image can be formed by only one turn of the photoreceptor drum. The image forming time can indeed be reduced for those images. The apparatus, however, has the following shortcomings. First, it cannot form images of four or more colors. Second, the colors of a reproduced image is limited to the colors of the toners of the developing units. To perfectly satisfy the customer's desire for a particular color of a reproduced image, the toner in the developing unit must be replaced by the new one of the desired color.

SUMMARY OF THE INVENTION

The present invention has been made in view of the above circumstances and has an object of providing a color image forming apparatus and a method of using the same which can satisfy the need of reducing the time to form a two-color image with the color image reproduction performance as desired by customers, and further can form a color image of four or more colors.

Additional objects and advantages of the invention will be set forth in part in the description which follows and in part will be obvious from the description, or may be learned by practice of the invention. The objects and advantages of the invention may be realized and attained by means of the instrumentalities and combination particularly pointed out in the appended claims.

To achieve the objects and in accordance with the purpose of the invention, as embodied and broadly described herein, a color image forming apparatus of the invention, as shown in FIG. 1(*a*), comprises:

a latent image bearing body 1 for bearing a latent electrostatic image thereon;

monochromatic latent image forming means 2 for forming on the latent image bearing body 1 a negative latent image Zn whose image area potential is lower in absolute value than a background potential or a positive latent image Zp whose image area potential is higher in absolute value than the background potential;

monochromatic developing means 3 for developing the latent image Zn or Zp formed by the monochromatic latent image forming means 2 with a monochromatic toner Ts;

multi-color latent image forming means 4 for forming on the latent image bearing body a latent image Zp or Zn of a different type from that of the latent image formed by the monochromatic latent image forming means 2, the multi-color latent image forming means being located upstream or downstream of the monochromatic latent image forming means 2;

multi-color developing means 5 including a plurality of selectable developing units 5*a*, 5*b*, 5*c* with toners Ta, Tb, Tc of different colors except black, for developing the latent image Zp or Zn formed by the multi-color latent image forming means 4 with one or two color toners of selected one or two of the developing units;

pre-transfer processing means 6 for arranging polarities of a plurality of toner images produced by the monochromatic developing means 3 and the multi-color developing means 5 into the same polarity; and transfer means 7 for transferring the toner images with the arranged polarity on a record sheet 8 at a time.

In the color image forming apparatus thus arranged, the latent image bearing body may be suitably designed according to the type of the latent image forming means. For example, it may be a photoreceptor when a latent electrostatic image is formed by light, and be a dielectric member when the latent electrostatic image is formed by ions. The latent image bearing body 1 may take the form of a drum or a belt, for example. Further, it may be charged positively or negatively.

The monochromatic latent image forming means 2 and the multi-color latent image forming means 4 are each provided with latent image writing means for forming a latent electrostatic image on the latent image bearing body 1. When the surface of the latent image bearing body 1 must be previously charged in writing a latent electrostatic image, charging means must be provided.

For the latent image writing means of the type using a light beam for writing the latent image, it may be a combination of an exposure lamp and an optical focusing system, a laser, an LED, or a liquid crystal shutter, for example. For the latent image writing means of the type using ions for writing the latent image, it may be a discharge head, for example.

For the monochromatic developing means 3, if the developer mainly containing a monochromatic toner Ts such as black toner is used, the developing system and the kind of the developer may be selected properly. For the multi-color developing means 5, if it includes a plurality of developing units 5*a*, 5*b*, and 5*c* using respective plural color toners (e.g., three kinds) except a black toner, the developing system and the kinds of the developers may be selected properly. In this case, the polarity of the charged toner of the monochromatic developing means 3 must be opposite to that of the charged toner of the multi-color developing means 5. Further, it is preferable to employ the developing bias system using two-component developer when taking the developing efficiency into consideration.

The monochromatic developing means 3 or the multi-color developing means 5 disposed in the post-stage, or the developing units of the second and the subsequent stages in the multi-color developing means disposed in the post-stage, will be considered here. When the developing bias system using the two-component developer is employed, it is preferable to soften the magnetic brush by the developer. This may be realized by using the carrier of low density for the developer, by providing repulsive magnetic poles at the developing location on the developer bearing body, and by reducing the moving speed of the developer bearing body with respect to the latent image bearing body 1 (Japanese Patent Application Unexamined Publication Nos. Sho. 63-142363, Hei. 1-287581 and Hei. 2-19875), or by any other suitable methods. Alternatively, use of the non-contact developing system is preferable.

The multi-color developing means must be designed so as to be able to realize the superposing of two different toners. For example, where a latent image is developed by using two toners, e.g., Ta and Tb, of the developing units, all one has to do is to adjust the degrees of the developments by the toners Ta and Tb under the condition that different developing bias voltages are respectively applied to the selected developing units 5*a* and 5*b*.

The toners may be properly selected for the multi-color developing means 5. If it is desired to reproduce a full-color image, three developing units must be provided, which contain toners Ta to Tc of cyan, magenta and yellow. Further, it is preferable to select one or two developing units according to a desired reproduction color.

The pre-transfer processing means 6 may be appropriately designed on condition that the polarities of the toner images on the latent image bearing body 1 can be arranged. In such a case where the latent image bearing body 1 is a photoreceptor, for example, means to reduce potential in the toner image areas on the latent image bearing means 1 is preferably used for achieving good transfer efficiency of the toner images. This is realized by executing the exposure process concurrently with the charging process or after the charging process.

The transfer means 7 may be realized in any way provided that it can transfer the toner image from the latent image bearing body 1 onto the record sheet 8. The electrostatic image transfer method and the thermal image transfer method may be enumerated for the typical examples.

An image forming process for forming two color images by using the color image forming apparatus as mentioned above, as shown in FIG. 1(*b*), comprises:

a monochromatic toner image forming step A1 performed one time in which in one rotation cycle of the latent image bearing body 1, a latent image of a predetermined type is formed on the latent image bearing body 1 by the monochromatic latent image forming means 2, and the latent image thus formed is developed by the monochromatic developing means 3;

a multi-color toner image forming step A2 performed one time in which in the one rotation cycle of the latent image bearing body 1, a latent image of a different type from that of the latent image formed by the monochromatic latent image forming means 2 is formed on the latent image bearing body 1 by the multi-color latent image forming means 4, and the latent image thus formed is developed with two color toners of the multi-color developing means 5; and a toner image transfer step A3 in which in the one rotation cycle of the latent image bearing body 1, polarities of monochromatic and multi-color toner images are arranged by the pre-transfer processing means 6 into the same polarity, and the toner images are transferred onto a record sheet 8 at a time by the transfer means 7.

An image forming process for forming a color image of n ($n \geqq 3$) colors by using the color image forming apparatus, as shown FIG. 1(*c*), comprises:

a monochromatic toner image forming step B1 performed one time in which in one of $(n-1)$ rotation cycles of the latent image bearing body 1, a latent image of a predetermined type is formed on the latent image bearing body 1 by the monochromatic latent image forming means 2, and the latent image thus formed is developed by the monochromatic developing means 3;

a multi-color toner image forming step B2 performed $(n-1)$ times in which in each of the $(n-1)$ rotation cycles of the latent image bearing body 1, a latent image of a different type from that of the latent image formed by the monochromatic latent image forming means 2, is formed on the latent image bearing body 1 by the multi-color latent image forming means 4, and the latent image thus formed is developed by the multi-color developing means 5; and a toner image transfer step B3 in which in an $(n-1)$th rotation cycle of the latent image bearing body 1, polarities of monochromatic and multi-color toner images are arranged by pre-transfer processing means 6 into the same polarity, and the toner images are transferred onto a record sheet 8 at a time by the transfer means 7.

In the image forming process shown in FIG. 1(*c*), when the latent image forming means 2 and 4 employ a light beam system, and the toner Ts of the monochromatic developing means 3 is opaque, the monochromatic toner image forming step B1 is preferably performed in the $(n-1)$th cycle of the latent image bearing body 1.

When a two-color image is formed by using the color image forming apparatus, a negative latent image Zn, for example, which corresponds to a monochromatic image on the latent image bearing body 1 is developed by a monochromatic toner Ts, in the monochromatic toner image forming step A1. In the multi-color toner image forming step A2, a positive latent image Zp, for example, which corresponds to a multi-color image on the latent image bearing body 1, is superposedly developed by two color toners Ta and Tb, for example. In the toner image transfer step A3, the monochromatic toner image and the multi-color toner image are transferred on the record sheet 8 at a time.

In the image forming process as mentioned above, the color image of two colors is formed in one cycle where the latent image bearing body 1 rotates one time.

Consider a case where of the toner images formed in the monochromatic toner image forming step A1 and the multi-color toner image forming step A2, the toner image first formed comes in contact with that formed later. In this case, the toners of the images will newer be mixed with each other, because the polarity of the monochromatic toner image is different from that of the multi-color toner image. Further, even if the toner of the first formed toner image enters the housing of the developing means for the process to form the later-formed toner image, the toner of the later-formed toner image which exists within the housing repels the toner of the first-formed toner image because of the different polarities of them. Accordingly, the toner of the first-formed toner image is readily discharged from the housing of the developing means, and hence it is not accumulated within the housing.

It is noted that the multi-color toner image results from the superposed development with different toners. This fact implies that the color of the multi-color toner image can be adjusted to be different from the original colors of the toners.

When a three-color image is formed by using the color image forming apparatus, a negative latent image Zn, for example, which corresponds to the monochromatic image on the latent image bearing body 1 is formed by the monochromatic toner Ts in one of the cycles of the latent image bearing body 1, in the monochromatic toner image forming step B1. In the multi-color toner image forming step B2, each of positive latent images Zp corresponding to a plurality of multi-color images on the latent image bearing body 1 are developed by one or two color toners in each cycle of the latent image bearing body 1. In the toner image transfer step A3, the monochromatic toner image and the plurality of the multi-color toner images are transferred on the record sheet 8 at a time in the final cycle of the latent image bearing body 1.

In the image forming process as mentioned above, a color image of n-color systems can be formed through (n−1) cycles.

BRIEF DESCRIPTION OF THE DRAWINGS

The accompanying drawings, which are incorporated in and constitute a part of this specification illustrated embodiment of the invention and, together with the description, serve to explain the object, advantages and principles of the invention. In the drawings, FIG. 1(*a*) is an explanatory diagram showing the construction of a color image forming apparatus according to the invention.

DETAILED DESCRIPTION OF THE PREFERRED EMBODIMENTS

The present invention will be described in detail with reference to the accompanying drawings.

EMBODIMENT 1

Basic Construction

Figure 1A:
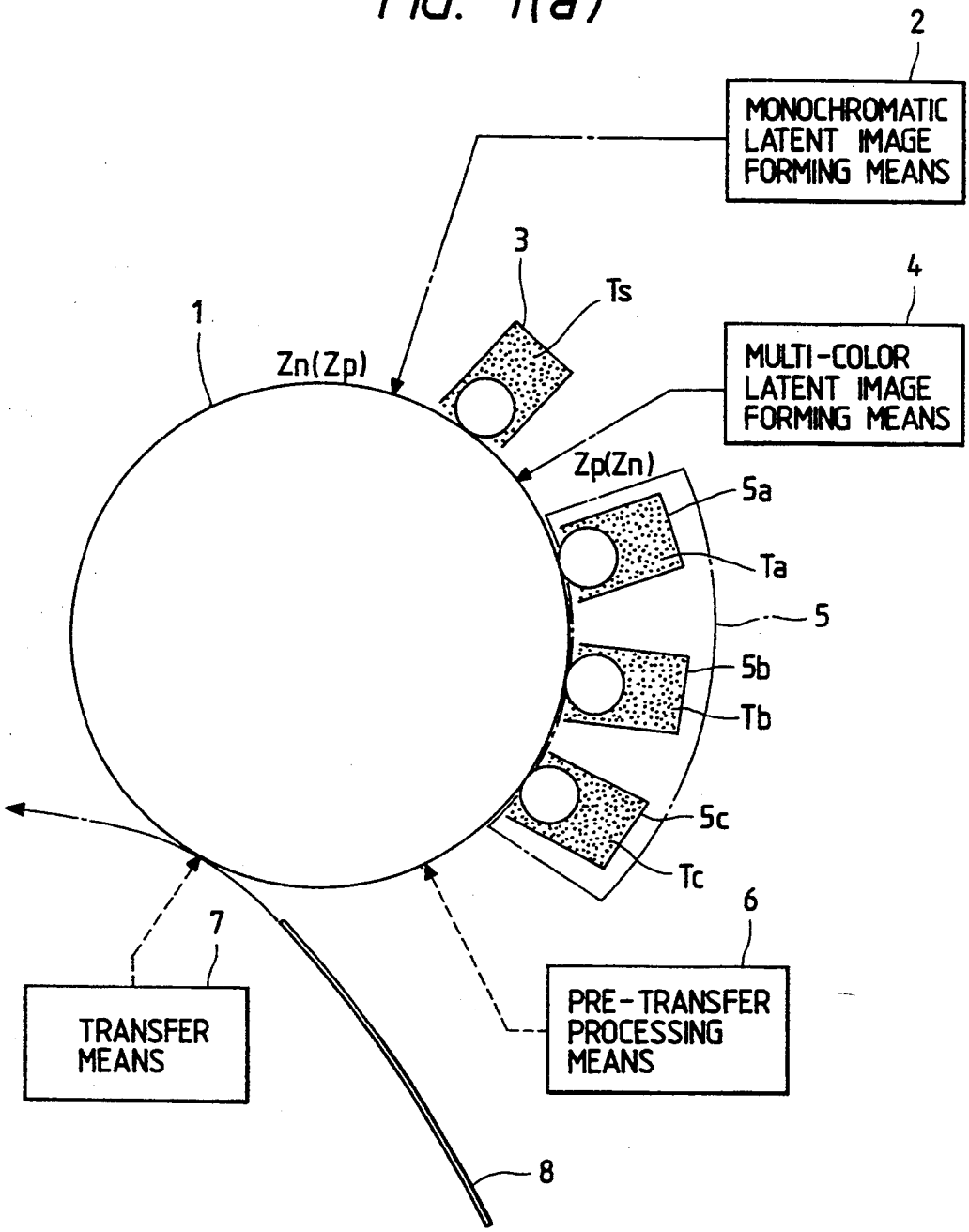
FIGS. 1(*b*) and 1(*c*) are explanatory diagrams showing methods of using the color image forming apparatus of the invention.
Figure 1B:
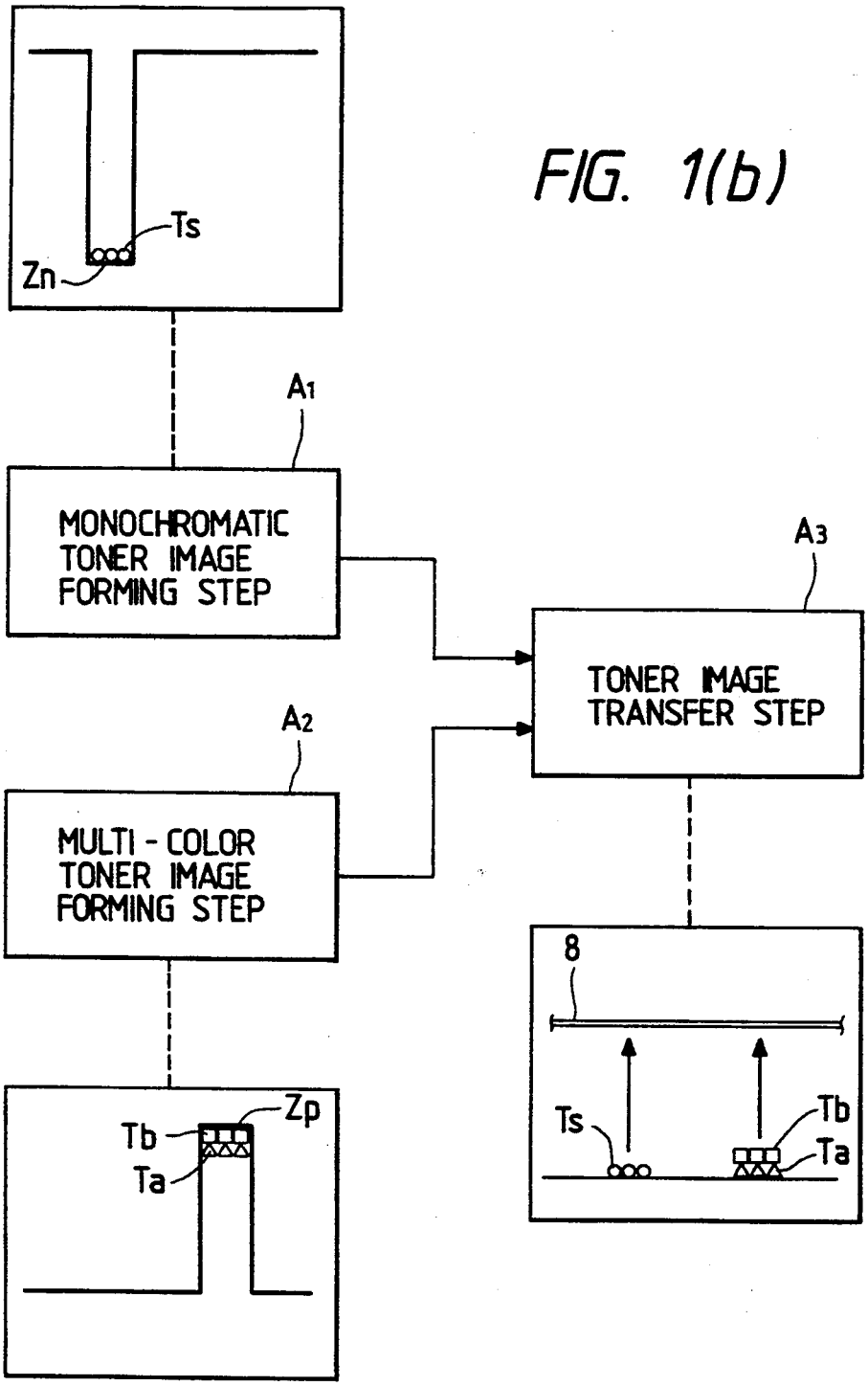
Figure 1C:
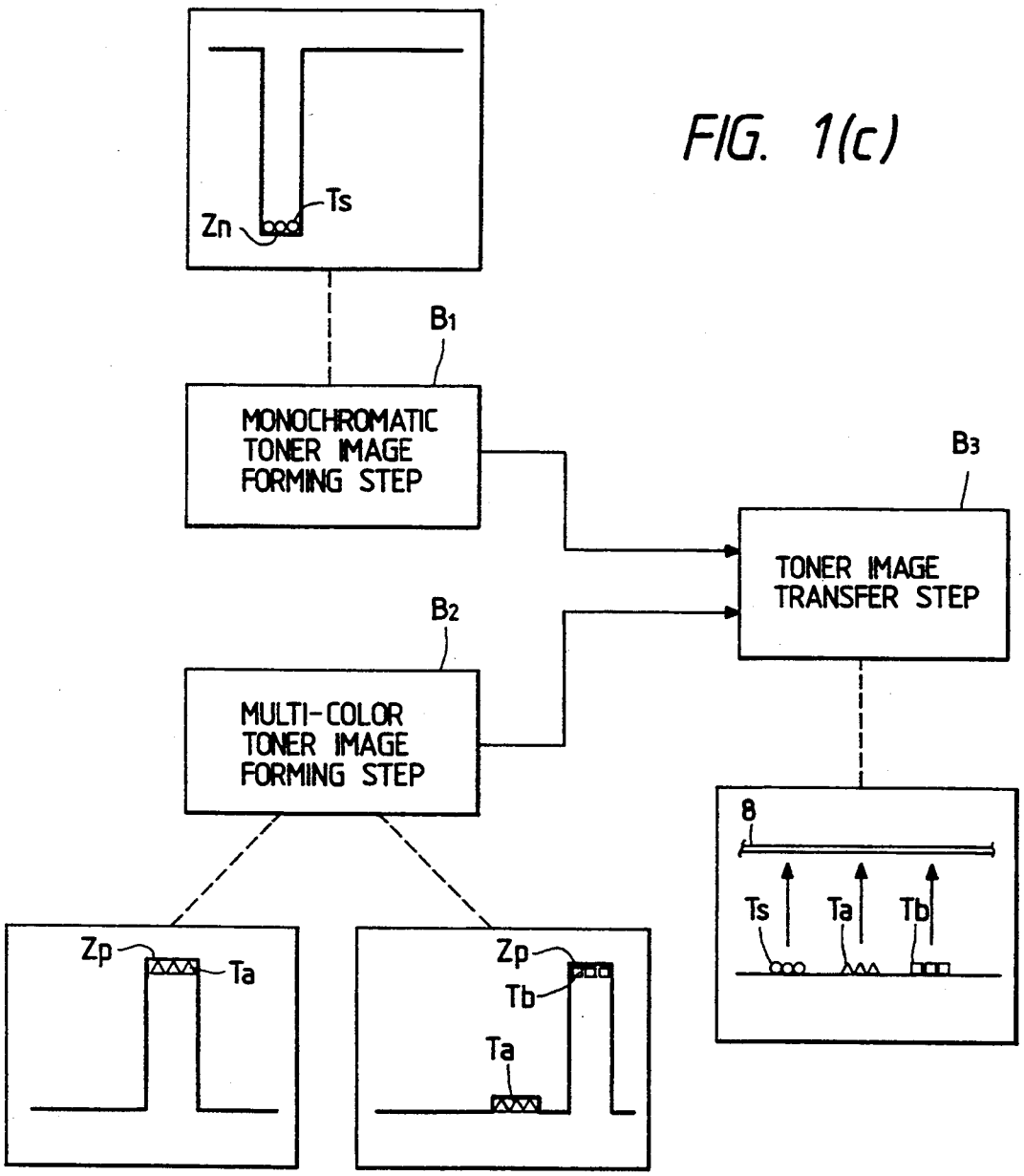
Figure 2:
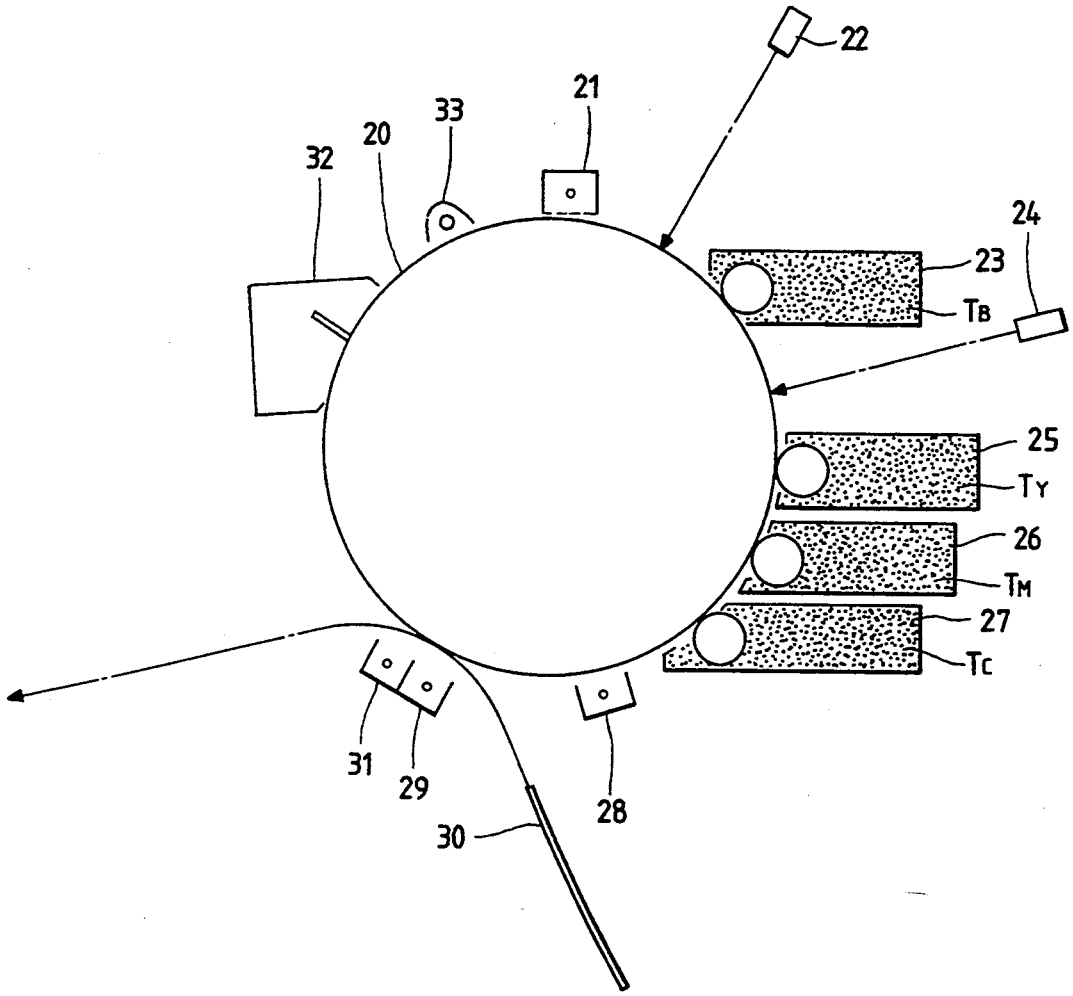
FIG. 2 is a schematic diagram showing embodiment 1 of the invention which is a color printer incorporating the invention.

FIG. 2 is a schematic diagram showing embodiment 1 of the invention which is a color printer incorporating the invention.

In the figure, reference numeral 20 designates a photoreceptor of the OPC (organic photoconductor), which is of the negative charge type and takes the form of a drum. A charge scorotron 21 previously charges the photoreceptor 20. A laser for monochrome 22 forms on the photoreceptor 20 a monochromatic negative latent image corresponding to a monochromatic image. A monochromatic developing unit 23 of the two-component magnetic brush developing type inversely develops the monochromatic negative latent image with a black toner $T_B$ (negative) as a monochromatic toner. A laser for multi-color 24 forms a multi-color positive latent image corresponding to a multi-color image, on the photoreceptor 20. A multi-color first developing unit 25 of the two-component magnetic brush developing type normally develops a multi-color positive latent image with yellow toner $T_Y$ (positive). A multi-color second developing unit 26 of the two-component magnetic brush developing type normally develops a multi-color positive latent image with magenta toner $T_M$ (positive). A multi-color third developing unit 27 of the two-component magnetic brush developing type normally develops a multi-color positive latent image with cyan $T_C$ (positive). A pre-transfer corotron 28 is for arranging the polarities of the toner images formed on the photoreceptor 20 into the positive polarity, for example. A transfer corotron 29 charges a record sheet 30 and electrostatically transfers the toner images from the photoreceptor 20 onto the record sheet 30 at a time. A detach corotron 31 removes charges from the record sheet 30 on which the toner images have been transferred, and peels the record sheet 30 off the photoreceptor 20. A cleaner 32 removes the residual toner left on the photoreceptor 20. A quenching lamp 33 quenches residual charges on the photoreceptor 20.

Figure 3:
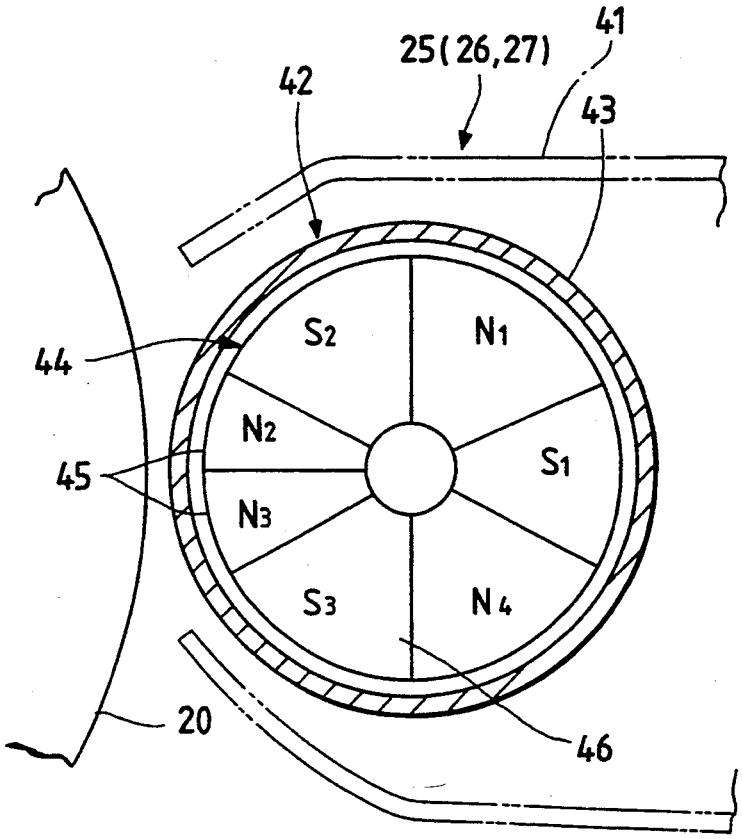
FIG. 3 is a sectional view showing a key portion of a multi-color developing unit.
Figure 4:
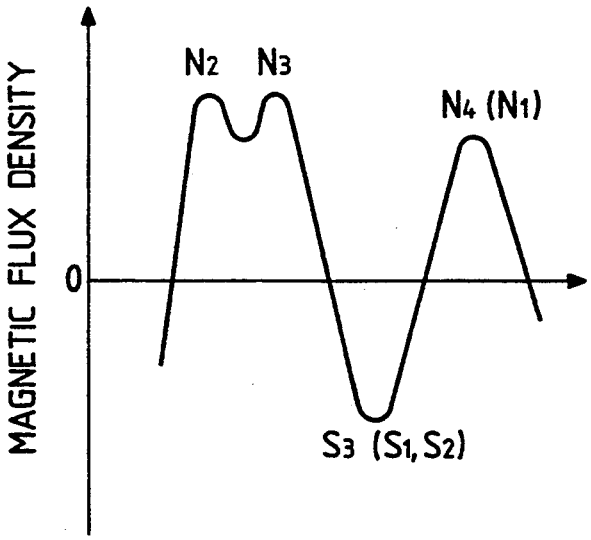
FIG. 4 is a graph showing a variation of magnetic flux density with respect to magnetic poles.

In the instant embodiment, each of the multi-color developing units 25 to 27 is constructed as shown in FIGS. 3 and 4. As shown, a developing roll 42 is disposed within a housing 41. The developing roll 42 is made up of a rotating sleeve 43 and a magnet roll 44 fixedly installed within the rotating sleeve 43. The magnet roll 44 includes seven poles (N1 to N4, and S1 to S3) that are asymmetrically magnetized. A magnetic flux density of main poles 45 (as repulsive magnetic poles consisting of the poles N2 and N3) is set at approximately 1200 gauss. The difference between its top and bottom of a curve representing a variation of the magnetic flux density is set at approximately 500 gauss. A magnetic flux density of another magnetic pole 46 is set at approximately 800 gauss. A carrier of 4 g/cm$^3$ or less in density in which magnetic particles are dispersed in resin binder is used for the developer for each of the multi-color developing units 25 to 28.

Operation

The operations of the color printer of the instant embodiment will be described when the printer is in the respective image forming modes.

A process speed of the photoreceptor 20 of the embodiment is 150 mm/sec.

Figure 5:
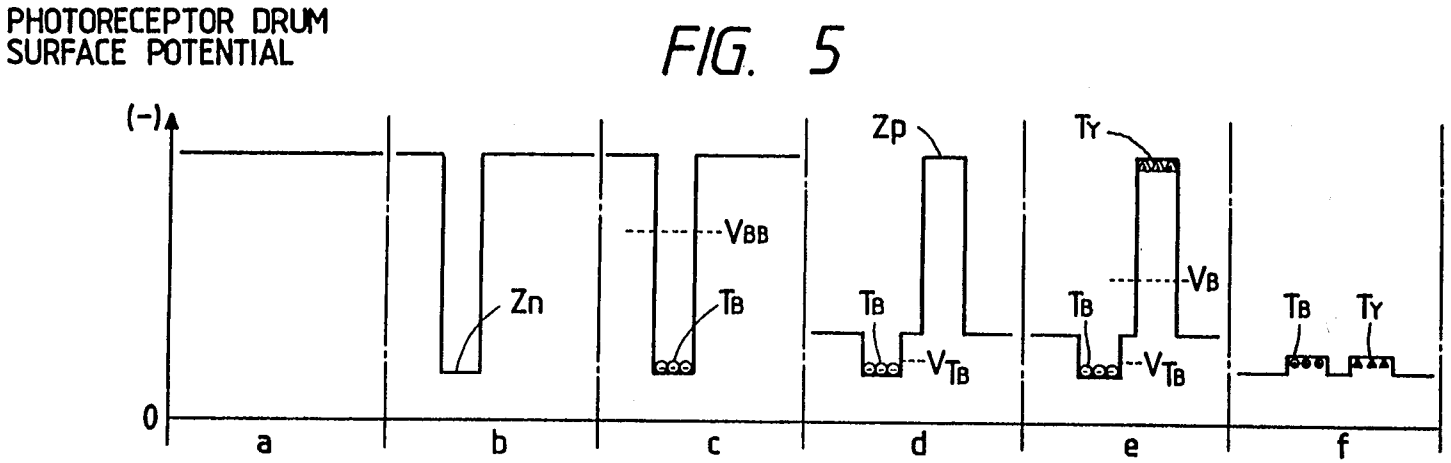
FIG. 5 is an explanatory diagram showing an image forming process in a two-color regular color image mode.

1) 2-Color Regular Color Image Mode (FIG. 5)

In this mode, a monochromatic image is developed by the black toner $T_B$, and a multi-color image is developed with one of the toners already provided, for example, yellow toner $T_Y$.

(1) Uniform Charging Step (step "a"):

The surface of the photoreceptor 20 is uniformly charged at −600 V.

(2) Monochromatic Exposure Step (step "b"):

A monochromatic negative latent image Zn, in which the potential in image portions is lower than that in the background, is formed with the laser for monochrome 22 (a pattern generator is used for an experiment to generate an image signal, and it will also be used for the laser for multi-color). In the instant embodiment, the image portion potential is set at −100 V, while the background potential at −600 V.

(3) Monochromatic Developing Step (step "c"):

A developing bias voltage $V_{BB}$ of the monochromatic developing unit 23 is set at −400 V, and the negative latent image Zn is inversely developed with the black toner $T_B$ (negative).

(4) Multi-Color Exposure Step (step "d"):

A multi-color positive latent image Zp, in which the image portion potential is higher than the background potential, is formed with the laser for multi-color 24. In this case, the potential $V_{TB}$ of the monochromatic toner image is set to be smaller than the background potential. In this instance, the background potential is −200 V; the image portion potential, −580 V; and the potential $V_{TB}$ of the monochromatic toner image, about −130 V.

(5) Multi-Color First Developing Step (step "e"):

A developing bias voltage $V_{BY}$ of the multi-color first developing unit 25 is set at −300 V, and the positive latent image Zp is normally developed with the yellow toner $T_Y$ (positive).

In this case, the monochromatic toner image is retentively held by a well-type potential pattern. Therefore, the monochromatic toner image is hard to be destroyed, and the yellow toner $T_Y$ will be little mixed into the monochromatic toner image. Further, the peeled-off toner $T_B$ of the monochromatic toner image will little enter the multi-color first developing unit 25.

(6) Pre-Transfer Processing Step (step "f"):

A DC voltage of +1.5 kV on which an AC component of 400 Hz and 8.5 kVp-p is superposed is applied to a discharge wire of the pre-transfer corotron 28, thereby to arrange the polarities of the respective toner images into the positive polarity.

(7) Transfer Step (not shown):

A DC voltage of −1.5 kV on which an AC component of 400 Hz and 8.5 kVp-p is superposed is applied to a discharge wire of the transfer corotron 29. Then, the respective toner images are transferred from the photoreceptor 20 onto the record sheet 30 at a time. A regular color image of two colors, black and yellow, is formed.

Figure 6:
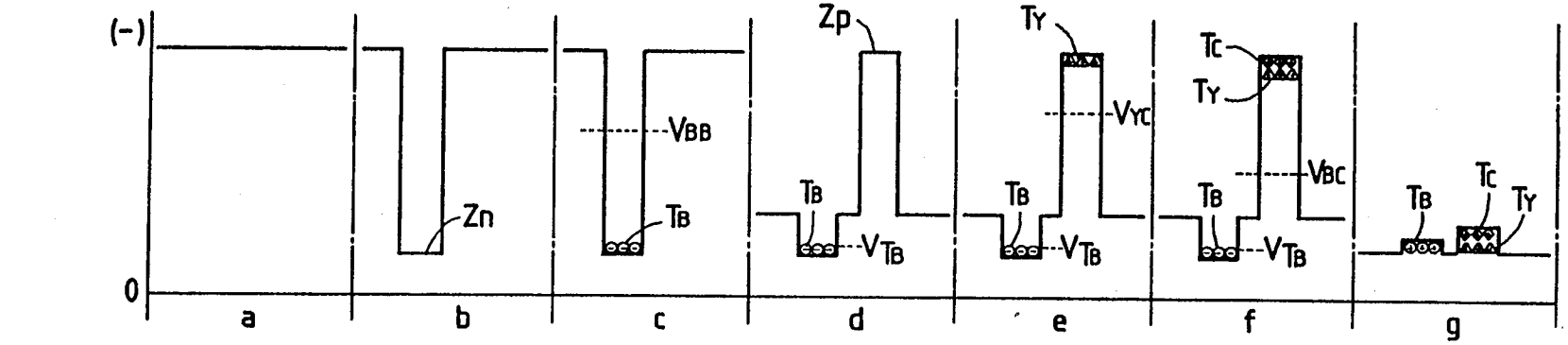
FIG. 6 is an explanatory diagram showing an image forming process in a two-color custom color image mode.

2) Two-Color Custom Color Image Mode (FIG. 6)

When this mode is selected, a two-color image can be formed, which includes a color which is different from the colors of the toners used and can be selected arbitrarily, to some extent, from among a variety of colors, according to a customer's wish. The mode is performed in the following sequence of process steps.

Steps (1) to (4):

The following steps (1) to (4) are the same as those of the two-color regular color mode as described above: (1) uniform charging step (step "a"), (2) monochromatic exposure step (step "b"), (3) monochromatic developing step (step "c"), and (4) multi-color exposure step (step "d").

(5) Multi-Color First Developing Step (step "e"):

A developing bias voltage $V_{BY}$ of the multi-color first developing unit 25 is set at −450 V, and the positive latent image Zp is normally developed with the yellow toner $T_{BY}$ (positive).

(6) Multi-Color Second Developing Step (step "f"):

A developing bias voltage $V_{BC}$ of the multi-color third developing unit 27 is set at −300 V which is different from the developing bias $V_{BY}$ of the multi-color first developing unit 25, and the positive latent image Zp is normally developed with the cyan toner $T_C$ (positive). Under this condition, the latent images are developed such that the cyan toner $T_C$ is superposed on the yellow toner $T_Y$. As a consequence, a multi-color image (green toner image) is formed with the cyan toner $T_C$ and the yellow toner $T_Y$.

In the multi-color first and second developing steps, the monochromatic toner image is retentively held by a well-type potential pattern. Therefore, the monochromatic toner image is hard to be destroyed, and the yellow toner $T_Y$ and the cyan toner $T_C$ will little be mixed into the monochromatic toner image. Further, the peeled-off toner $T_B$ for the monochromatic toner image will little enter the multi-color first developing unit 25 and the multi-color third developing unit 27.

Steps (7) and (8):

The steps (7) and (8), pre-transfer processing step (step "g") and transfer step (not shown) are the same as those of the two-color regular color image mode. The polarities of the toner images on the photoreceptor 20 are arranged into the positive polarity, and then transferred onto the record sheet 30 at a time. As a result, a two-color image of black and green (resulting from the mixing of cyan and yellow) is formed.

Figure 7A:
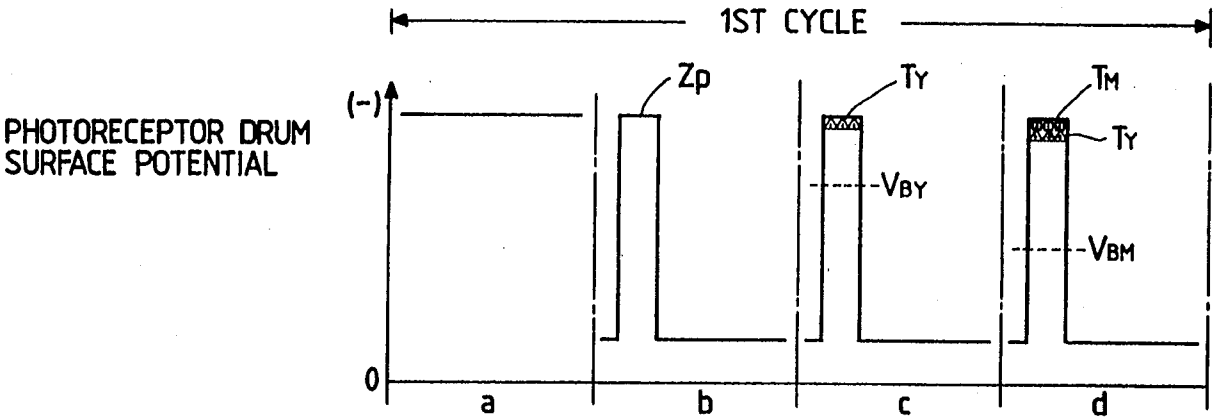
FIG. 7 is an explanatory diagram showing an image forming process in a three-color image mode.
Figure 7B:
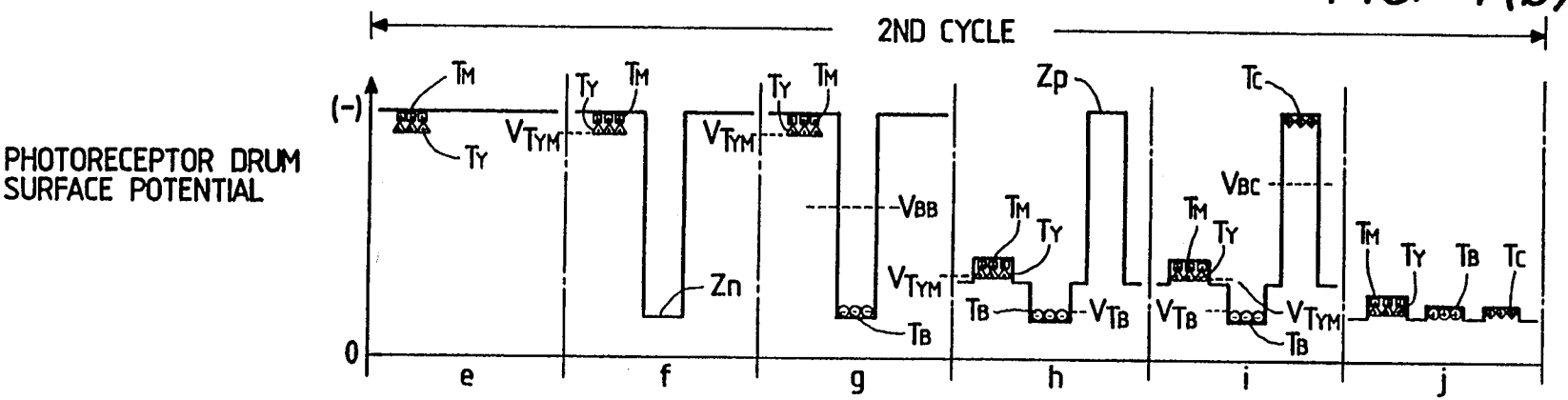

3) Three-Color Image Forming Mode (FIG. 7)

This mode will be described using a case to form a three-color image of cyan, red and black.

Photoreceptor 20: 1st Cycle (1) Uniform Charging Step (step "a"):

The surface of the photoreceptor 20 is uniformly charged at −600 V.

(2) 1st Cycle Multi-Color Exposure Step (step "b"):

A multi-color positive latent image Zp, in which the image portion potential is higher than the background potential, is formed with the laser for multi-color 24. In this instance, the image portion potential is set at −600 V, and the background potential at −100 V.

(3) 1st Cycle Multi-Color First Developing Step (step "c"):

A developing bias voltage $V_{BY}$ of the multi-color first developing unit 25 is set at −450 V, and the positive latent image Zp is normally developed with the yellow toner $T_Y$ (positive).

(4) 1st-Cycle Multi-Color Second Developing Step (step "d"):

A developing bias voltage $V_{BM}$ of the multi-color second developing unit 26 is set at −200 V, and the positive latent image Zp is normally developed with the magenta toner $T_M$(positive), while being superposed on the yellow toner image already formed.

At this stage, a first multi-color toner image of red resulting from the mixing of the yellow toner $T_Y$ and the magenta toner $T_M$ has been formed.

In this cycle, the pre-transfer process and the transfer process are placed in an off state. Further, the monochromatic developing unit 23 and the blade of the cleaner 32 are retracted from the photoreceptor 20.

Photoreceptor 20: 2nd Cycle (5) Uniform Charging Step (step "e"):

The surface of the photoreceptor 20 is uniformly charged at −600 V.

(6) Monochromatic Exposure Step (step "f"):

A monochromatic negative latent image Zn, in which the potential in image portions is lower than that in the background, is formed with the laser for monochrome 22. In the instant embodiment, the image portion potential is set at −100 V, the background potential at −600 V, and the multi-color first toner image potential $V_{TYM}$ at −580 V.

(7) Monochromatic Developing Step (step "g"):

A developing bias voltage $V_{BB}$ of the monochromatic developing unit 23 is set at −400 V, and the negative latent image Zn is inversely developed with the black toner $T_B$(negative).

(8) 2nd Cycle Multi-Color Exposure Step (step "h"):

A second multi-color positive latent image Zp, in which the image portion potential is higher than the background potential, is formed with the laser for multi-color 24. In this instance, the image portion potential is −600 V; the background potential, −250 V; the multi-color first toner image potential $V_{TYM}$, −350 V; and the monochromatic toner image potential $V_{TB}$, −150 V.

(9) 2nd Cycle Multi-Color Developing Step (step "i"):

A developing bias voltage $V_{BY}$ of the multi-color developing unit 27 is set at −450 V, and the second multi-color positive latent image Zp is normally developed with the cyan toner $T_C$ (positive).

Steps (10) and (11):

The pre-transfer processing step (step "i") and the transfer step (not shown) are performed in substantially the same manner as the two-color regular color image mode. As a result, the polarities of the toner images on the photoreceptor 20 are arranged into the positive polarity. The toner images are transferred onto the record sheet 30 at once. The resultant is a three-color image of red resulting from the mixing of yellow and magenta, black and cyan.

During the image forming process as just mentioned, even if the black toner $T_B$ peeled off the monochromatic toner image enters the housings of the multi-color developing units 25 to 27, the black toner will never be accumulated because of the polarity difference between those toners.

4) "n" (n≧4) Color Image Forming Mode

In this image forming mode, the photoreceptor 20 is turned (n−1) cycles. In every cycle of the photoreceptor, by using one or two color toners of the multi-color developing units 25 to 27, a multi-color positive latent image Zp corresponding to the one or two toners is developed. In the (n−1)th cycle, a monochromatic negative latent image Zn is developed with the black toner of the monochromatic developing unit 23. Finally, the toner images are transferred from the photoreceptor 20 onto the record sheet 30 at once.

The instant image forming mode can form a color image of a maximum of seven colors; yellow, magenta and cyan corresponding to the toner colors, green as the mixture of cyan and yellow, blue as the mixture of cyan and magenta, and red as the mixture of yellow and magenta, and black.

Image Forming Characteristics

Generally, printers print data in black and a form in a suitable color other than black. In one cycle of the invention, a negative latent image is inversely developed with the black toner $T_B$ to form a black image. Then, a positive latent image is normally developed with a color toner of a color except black to form a color toner image. Therefore, even if a positive latent image corresponding to a color (except black) image is formed in a black image area, the black image area will never be developed with the color (except black) toner. This fact indicates that the data of the black image is never missed.

EMBODIMENT 2

Basic Construction

Figure 8:
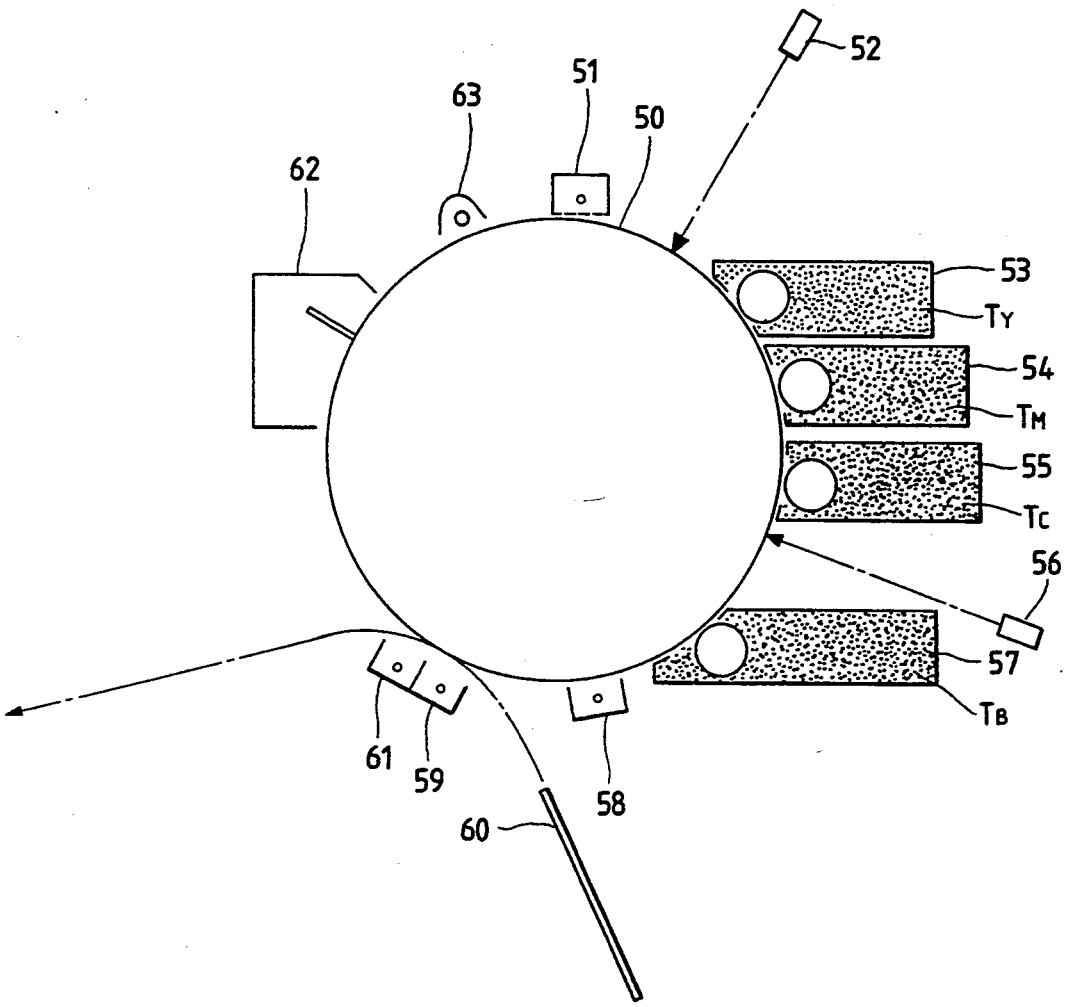
FIG. 8 is a schematic diagram showing embodiment 2 of the invention which is a digital color copying machine incorporating the invention.

FIG. 8 is a schematic diagram showing embodiment 2 of the invention which is a digital color copying machine incorporating the invention.

The color copying machine detects optical information derived from an original document scan system (not shown) by a color sensor, and generates multi-color (colors other than black) image signals and a monochromatic (black) image signal, by an image signal generator, on the basis of the output signals of the color sensor.

In the figure, reference numeral 50 designates a photoreceptor of the OPC, which is of the negative charge type and takes the form of a drum. A charge scorotron 51 previously charges the photoreceptor 50. A laser for multi-color 52 forms on the photoreceptor 50 a multi-color negative latent image corresponding to a multi-color image. A multi-color first developing unit 53 of the two-component magnetic brush developing type inversely develops the multi-color negative latent image with a yellow toner $T_Y$(negative). A multi-color second developing unit 54 of the two-component magnetic brush developing type inversely develops a multi-color negative latent image with magenta toner $T_M$ (negative). A multi-color third developing unit 55 of the two-component magnetic brush developing type inversely develops a multi-color positive latent image with cyan $T_C$ (negative). A laser for monochrome 56 forms on the photoreceptor 20 a monochromatic positive latent image corresponding to a monochromatic image. A monochromatic developing unit 57 of the two-component magnetic brush developing type normally develops the monochromatic positive latent image with a black toner $T_B$ (positive) as a monochromatic toner. A pre-transfer corotron 58 is for arranging the polarities of the toner images formed on the photoreceptor 50 into the positive polarity, for example. A transfer corotron 59 charges a record sheet 60 and electrostatically transfers the toner images from the photoreceptor 50 onto the record sheet 60 at a time. A detach corotron 61 removes charges on the record sheet 60 on which the toner images have been transferred, and peels the record sheet 60 off the photoreceptor 50. A cleaner 62 removes the toner left on the photoreceptor 50. A quenching lamp 63 quenches residual charges on the photoreceptor 50.

Operation

Figure 9:
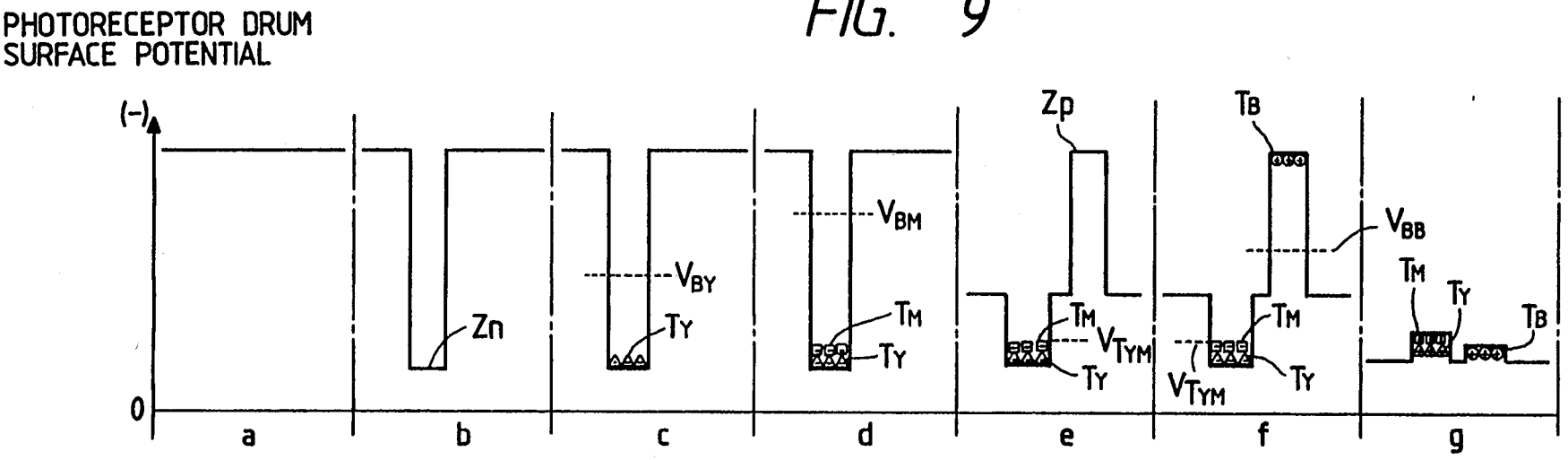
FIG. 9 is an explanatory diagram showing an image forming process in a two-color custom color image mode.

1) Two-Color Custom Color Image Forming Mode (FIG. 9)

This image forming mode will be described using a case to form a two-color image of black and red as the combination of yellow and magenta.

(1) Uniform Charging Step (step "a"):

The surface of the photoreceptor 50 is uniformly charged at −600 V.

(2) Multi-Color Exposure Step (step "b"):

A multi-color negative latent image Zp, in which the image portion potential is lower than the background potential, is formed with the laser for multi-color 52. In this instance, the image portion potential is −100 V and the background potential −600 V.

(3) Multi-Color First Developing Step (step "c"):

A developing bias voltage $V_{BY}$ of the multi-color first developing unit 53 is set at −300 V, and the negative latent image Zp is inversely developed with the yellow toner $T_Y$ (negative).

(4) Multi-Color Second Developing Step (step "d"):

A developing bias voltage $V_{BM}$ of the multi-color second developing unit 54 is set at −450 V which is different from the developing bias $V_{BY}$ of the multi-color first developing unit 53, and the negative latent image Zn is inversely developed with the magenta toner $T_M$ (negative). Under this condition, the latent images are developed such that the magenta toner $T_M$ is superposed on the yellow toner $T_Y$. As a consequence, a multi-color image (red toner image) consisting of magenta toner $T_M$ and the yellow toner $T_Y$ is formed.

(5) Monochromatic Exposure Step (step "e"):

A monochromatic positive latent image Zp, in which the image portion potential is higher than the background potential, is formed with the laser for monochrome 56. In the instant embodiment, the image portion potential is set at −580 V; the background potential, −250 V; and the multi-color toner image potential $V_{TMY}$, −150 V.

(6) Monochromatic Developing Step (step "f"):

A developing bias voltage $V_{BB}$ of the monochromatic developing unit 57 is set at −350 V, and the positive latent image Zp is normally developed with the black toner $T_B$ (positive).

In the monochromatic developing step, the multi-color toner image is retentively held by a well-type potential pattern. Therefore, the multi-color toner image is hard to be destroyed, and the black toner $T_B$ will be little mixed into the multi-color toner image. Further, the peeled-off toners $T_Y$ and $T_M$ of the multi-color toner image will little enter the housing of the monochromatic developing unit 57.

Steps (7) and (8):

The steps (7) and (8), pre-transfer processing step (step "g") and transfer step (not shown), are the same as those of the two-color regular color image mode in embodiment 1. The polarities of the toner images on the photoreceptor 50 are arranged into the positive polarity, and then the toner images are transferred onto the record sheet 60 at a time. A two-color image of black and red (resulting from the mixing of yellow and magenta) is formed.

For the two-color regular color image forming mode, one-time execution of the multi-color developing step suffices. The remaining processes are substantially the same as those in the above two-color custom color image forming mode.

Figure 10A:
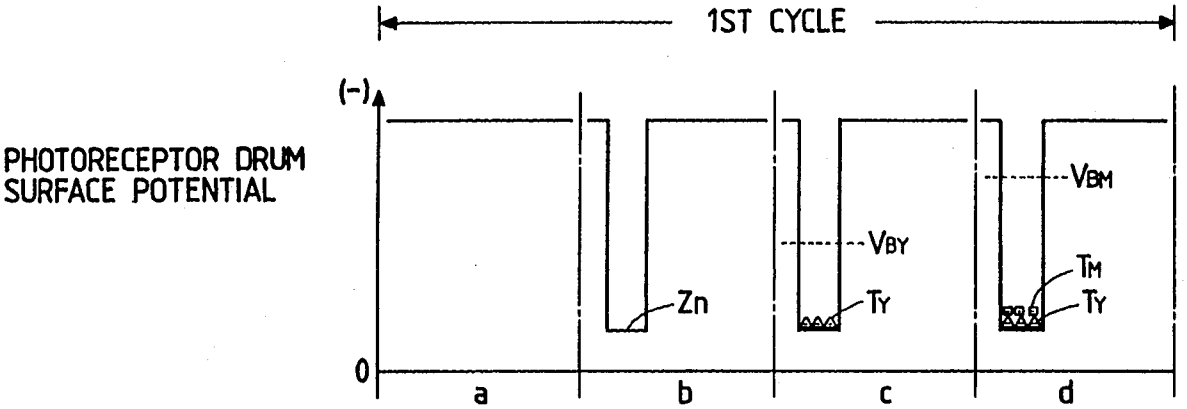
FIG. 10 is an explanatory diagram showing an image forming process in a three-color image mode.
Figure 10B:
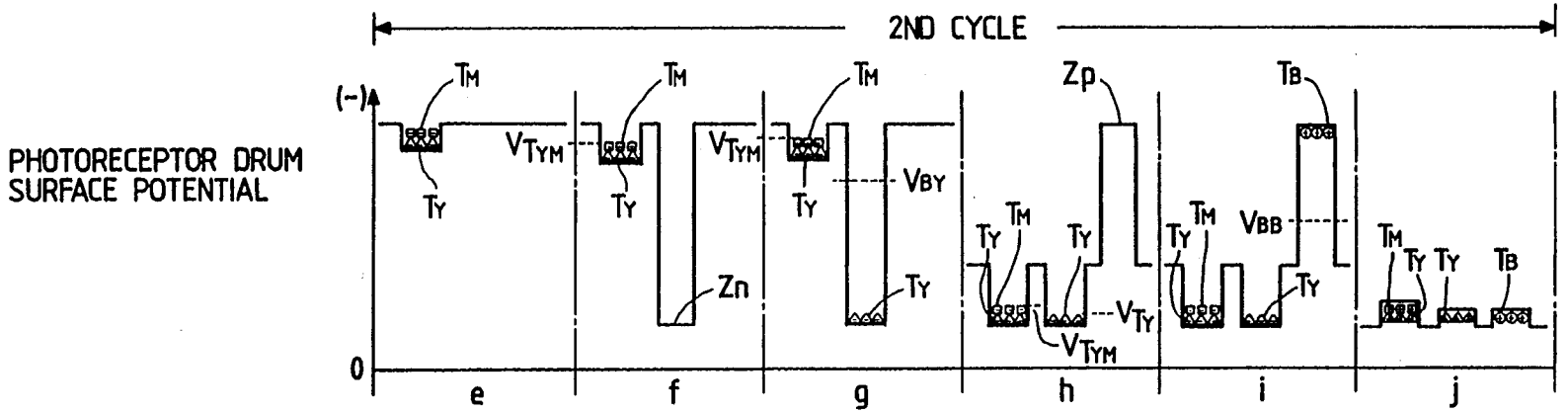

2) Three-Color Image Forming Mode (FIG. 10)

This mode will be described using a case to form a three-color image of red, yellow and black.

Photoreceptor 50: 1st Cycle (1) Uniform Charging Step (step "a"):

The surface of the photoreceptor 50 is uniformly charged at −600 V.

(2) 1st Cycle Multi-Color Exposure Step (step "b"):

A multi-color negative latent image Zn, in which the image portion potential is lower than the background potential, is formed with the laser for multi-color 52. In this instance, the image portion potential is −100 V, and the background potential is −600 V.

(3) 1st Cycle Multi-Color First Developing Step (step "c"):

A developing bias voltage $V_{BY}$ of the multi-color first developing unit 53 is set at −300 V, and the negative latent image Zn is inversely developed with the yellow toner $T_Y$ (negative).

(4) 1st-Cycle Multi-Color Second Developing Step (step "d"):

A developing bias voltage $V_{BM}$ of the multi-color second developing unit 54 is set at −450 V, and the negative latent image Zn is inversely developed with the magenta toner $T_M$ (negative), while being superposed on the yellow toner image already formed.

At this stage, a first multi-color image of red resulting from the mixing of the yellow toner $T_Y$ and the magenta toner $T_M$ is formed on the photoreceptor 50.

In this cycle, the pre-transfer process and the transfer process are placed in an off state. Further, the monochromatic developing unit 57 and the blade of the cleaner 62 are retracted from the photoreceptor 50.

Photoreceptor 50: 2nd Cycle (5) Uniform Charging Step (step "e"):

The surface of the photoreceptor 50 is uniformly charged at −600 V.

(6) 2nd Cycle Multi-Color Exposure Step (step "f"):

A second multi-color negative latent image Zn, in which the image portion potential is lower than the background potential, is formed with the laser for multi-color 52. In this instance, the image portion potential is −100 V; the background potential, −600 V; and the multi-color first toner image potential $V_{TYM}$, −550 V.

(7) 2nd Cycle Multi-Color Developing Step (step "g"):

A developing bias voltage $V_{BY}$ of the multi-color first developing unit 53 is set at −450 V, and the second multi-color negative latent image Zn is inversely developed with the yellow toner $T_Y$ (positive).

(8) Monochromatic Exposure Step (step "h"):

A monochromatic positive latent image Zp, in which the potential in image portions is higher than the background potential, is formed with the laser for monochrome 56. In the instant embodiment, the image portion potential is set at −580 V, the background potential at −250 V, the multi-color first toner image potential $V_{TYM}$ at −150 V, and the multi-color second toner image potential $V_{TY}$ at −130 V.

(9) Monochromatic Developing Step (step "i"):

A developing bias voltage $V_{BB}$ of the monochromatic developing unit 57 is set at −350 V, and the positive latent image Zp is normally developed with the black toner $T_B$ (positive).

Steps (10) and (11):

The steps (10) and (11), the pre-transfer processing step (step "j") and the transfer step (not shown) are performed in substantially the same manner as the two-color normal color image mode. The polarities of the toner images on the photoreceptor 50 are arranged into the positive polarity. The toner images are transferred onto the record sheet 60 at once. The resultant is a three-color image of red resulting from the mixing of yellow and magenta, yellow and black.

During the image forming process as just mentioned, even if the black toner comes in contact with the multi-color toner image, the black toner will never be mixed with the multi- color toner image. Further, even if the multi-color toners $T_Y$ and $Y_M$ peeled off the multi-color toner image enters the housings of the monochromatic developing units 57, the multi-color toners will never be accumulated therein because of the polarity difference between those toners.

3) "n" (n≧4) Color Image Forming Mode

In this image forming mode, the photoreceptor 50 is turned (n−1) cycles. In every cycle of the photoreceptor, by using one or two color toners of the multi-color developing units 53 to 55, a multi-color negative latent image Zn corresponding to the one or two toners is developed. In the (n−1)th cycle, a monochromatic positive latent image Zp is developed with the black toner of the monochromatic developing unit 57. Finally, the toner images are transferred from the photoreceptor 50 onto the record sheet 60 at once.

The instant image forming mode, as in the first embodiment, can form a color image of a maximum of seven colors; yellow, magenta, cyan, green, blue, red, and black.

Image Forming Characteristics

Since the color copying machine forms the black image in the final process step, the black toner $T_B$ will never be mixed into the multi-color toner images. In this respect, embodiment 2 improves over the embodiment 1. The color image formed has a good picture quality.

As seen from the foregoing description, the color image forming apparatus employs a method of transfer ring images of different colors onto the record sheet at a time. Accordingly, color images of two colors can be formed through one cycle where the latent image bearing body is turned one time. Color images of three or more colors can be formed through a plurality of cycles where the latent image bearing body turns plural times. The color image forming apparatus can reduce the time to form the two-color image which is frequently required in practical use, and provides an easy formation of multi-color images. If a plurality of color (except black) toner images are superposed when developed, a custom color image can readily be formed, which includes a color which is different from the colors of the toners used and can be selected arbitrarily, to some extent, from among a variety of colors, according to a customer's wish.

It is noted that the polarities of the toners of the monochromatic developing means and the multi-color developing means are different from each other. Because of the polarity difference, the color image forming apparatus is free from the phenomena of color contamination and toner mixing between the monochromatic and multi-color toners. This feature provides a good picture quality of the formed color image.

In the case of the bias-type developing units, since two toners can surely be superposed one on the other in image portions to form a custom color toner image, a good quality of custom color images can be maintained.

By properly constructing the multi-color developing units, a color image of six colors can be formed by using only three developing units.

The color image forming apparatus can reduce the time to form a color image, while it can readily form a two-color image including a color selected arbitrarily, to some extent, according to a use's preference.

Further, a three-color image including an original color of the color toner and a color selected arbitrarily, to some extent, according to a user's preference can readily be formed.

Even if the latent image forming means are of the light beam type, and if the toner of the monochromatic developing means 3 is opaque, the opaque toner will never interrupt the latent image formation by the latent image forming means, hence providing a good picture quality of the formed color image.

The foregoing description of preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A method of forming a color image in a color image forming apparatus comprising a latent image bearing body for bearing a latent electrostatic image thereon; monochromatic latent image forming means for forming a negative or positive type latent image on the latent image bearing body; monochromatic developing means for developing the negative or positive type latent image with a monochromatic toner to produce a monochromatic toner image; multi-color latent image forming means located upstream or downstream of the monochromatic latent image forming means, for forming on the latent image bearing body at least two additional latent images; multi-color developing means including a plurality of selectable developing units having respective toners of different colors except black, for developing the additional latent images with one color toner or two color toners of selected one or two of the developing units to produce a color toner image wherein each of the developing units is of a bias type, and wherein, in the case of superposedly developing the additional latent images with the two color toners of the selected two developing units, degrees of developments with the two toners are adjusted under the condition that different bias voltages are applied to the selected two developing units; pre-transfer processing means for arranging polarities of the plurality of toner images into the same polarity; and transfer means for transferring the plurality of toner images onto a recording sheet at one time; the method of forming a color image of n colors where n is an integer more than or equal to three, comprising:

a step of forming and developing the monochromatic latent image on the image bearing body in one of (n−1) rotation cycles of the latent image bearing body to produce the monochromatic toner image;

a step of setting a background voltage of the additional latent images to have an absolute value larger than a voltage of a portion of the monochromatic latent image on the image bearing body developed by the monochromatic toner;

a step of forming and developing (n−1) of the additional latent images in the respective (n−1) rotation cycles to produce multi-color toner images of (n−1) colors; and a step of arranging polarities of the monochromatic toner image and the multi-color toner images into the same polarity; and a step of transferring the monochromatic and multi-color toner images onto the recording sheet at one time.

2. The image forming method of claim 1, wherein the step of forming and developing the latent image on the image bearing body to produce the monochromatic toner image includes forming a negative latent image on the electrostatic latent image bearing body and inversely developing the negative latent image with a monochromatic toner.

3. The image forming method of claim 1, wherein the step of forming and developing the latent image on the image bearing body to produce the monochromatic toner image includes forming a positive latent image on the electrostatic latent image bearing body and normally developing the positive latent image with a monochromatic toner.

4. The image forming method of claim 1, wherein the step of forming and developing (n−1) of the additional latent images includes forming (n−1) negative latent images on the electrostatic latent image bearing body and inversely developing the (n−1) negative latent images.

5. The image forming method of claim 1, wherein the step of forming and developing (n−1) of the additional latent images includes forming (n−1) positive latent images on the electrostatic latent image bearing body and normally developing the (n−1) positive latent images.

6. The image forming method according to claim 1, further comprising a step of charging the electrostatic image bearing body with a negative voltage prior to the steps of forming and developing the latent images on the image bearing body.

7. The image forming method according to claim 1, further comprising a step of charging the electrostatic image bearing body with a positive voltage prior to the steps of forming and developing the latent images on the image bearing body.

8. An image forming method comprising the steps of:

forming a first electrostatic latent image on an electrostatic image bearing body;

developing the first electrostatic latent image with a first bias voltage;

developing the first electrostatic latent image with a second bias voltage having an absolute value smaller than the first bias voltage;

forming a negative second latent image on the electrostatic latent image bearing body;

inversely developing the negative second latent image;

setting a background voltage of a positive third latent image to have an absolute value larger than a voltage of a portion of the negative second latent image on which the toner is developed;

forming the positive third latent image on the electrostatic latent image bearing body;

normally developing the positive third latent image;

arranging polarities of respective toner images into the same polarity; and transferring the respective toner images onto a recording sheet at one time.

* * * * *